United States Patent [19]

Braun

[11] 4,046,115

[45] Sept. 6, 1977

[54] FREE PISTON ENGINE FUEL FEEDING APPARATUS

[76] Inventor: Anton Braun, 6421 Warren Ave., Minneapolis, Minn. 55435

[21] Appl. No.: 586,963

[22] Filed: June 16, 1975

[51] Int. Cl.[2] ..... F02B 71/00; F02D 39/10

[52] U.S. Cl. ..... 123/46 R; 123/73 CC; 123/120

[58] Field of Search ..... 123/46 R, 46 SC, 120, 123/192 B, 65 A, 73 C, 73 CC, DIG. 12; 60/DIG. 1; 251/324

[56] References Cited

U.S. PATENT DOCUMENTS

| | | | |
|---|---|---|---|
| 945,296 | 1/1910 | Valentine | 123/73 C |
| 1,720,414 | 7/1929 | Gruebler | 123/73 CC |
| 2,164,234 | 6/1939 | Erren | 123/65 A |
| 2,183,674 | 12/1939 | Erren | 123/DIG. 12 |
| 2,477,712 | 8/1949 | Anderson | 123/65 A |
| 3,198,180 | 8/1965 | Rose | 123/73 C |
| 3,472,278 | 10/1969 | Arfelt | 251/324 X |
| 3,722,481 | 3/1973 | Braun | 23/120 X |
| 3,853,100 | 12/1974 | Braun | 123/46 R |

FOREIGN PATENT DOCUMENTS

| | | | |
|---|---|---|---|
| 180,766 | 11/1935 | Switzerland | 123/65 A |

*Primary Examiner*—Carroll B. Dority, Jr.
*Assistant Examiner*—William Randolph
*Attorney, Agent, or Firm*—Alan M. Staubly

[57] ABSTRACT

A two-cycle free piston engine which is adapted to burn various types of fuel but is particularly adapted to burn gaseous fuel. It introduces the fuel through at least one hole in the side wall of at least one cylinder at a location inwardly of the cylinder air intake and exhaust ports so as to be closed by the power piston at a time or position before the compression pressure in the power cylinder is equal to the injection pressure and also not before the valving system has interrupted the fuel flow. This advantageously keeps the fuel admission controls out of the hottest portion of the cylinder's combustion chamber, gives safer and better mixing of fuel and air and prevents blow back of fuel in the fuel supply line.

The fuel admission is preferably started shortly before or after the air intake port is closed, but before the exhaust port is closed and not earlier than is sufficient to prevent the first fuel particles entering the cylinder from escaping through the exhaust port. The fuel flow is under the control of a valve that moves simultaneously with the piston and is open during a portion of the compression stroke of the piston and is closed during the power stroke thereof.

9 Claims, 5 Drawing Figures

FREE PISTON ENGINE FUEL FEEDING APPARATUS

In conventional free piston internal combustion engines, fuel is usually introduced into the air supply to the engine's combustion chamber before the air reaches the chamber by means such as a carburetor or is injected into the chamber as a spray through an orifice located in or near the cylinder head or a wall portion of the cylinder's combustion chamber after the air has entered the combustion chamber. In U.S. Pat. No. 3,707,143 there is disclosed a two cycle crankshaft type of engine wherein fuel enters the combustion chamber through an opening in the side wall of the cylinder but at a location below the inner or upper edge of the air intake port and the exhaust port. It is also noted that fuel is admitted into the combustion chamber during but near the end of the combustion chamber during but near the end of the combustion stroke of the piston.

The present invention is directed to a free piston type of engine in which through one or more holes at a location inwardly of the air intake and the exhaust ports, and preferably, radially inwardly and somewhat towards the inner end of the combustion chamber. Fuel flow into the cylinder is preferably initiated through a control valve during the compression stroke of the piston but before the exhaust port is closed by the piston and possibly even before the air intake port is closed, depending on how long it takes for entering fuel particles to reach the exhaust port or ports. The fuel administration is preferably terminated by the piston covering the fuel inlet holes but may be terminated earlier by the control valve in certain applications of the invention.

Figure 1:
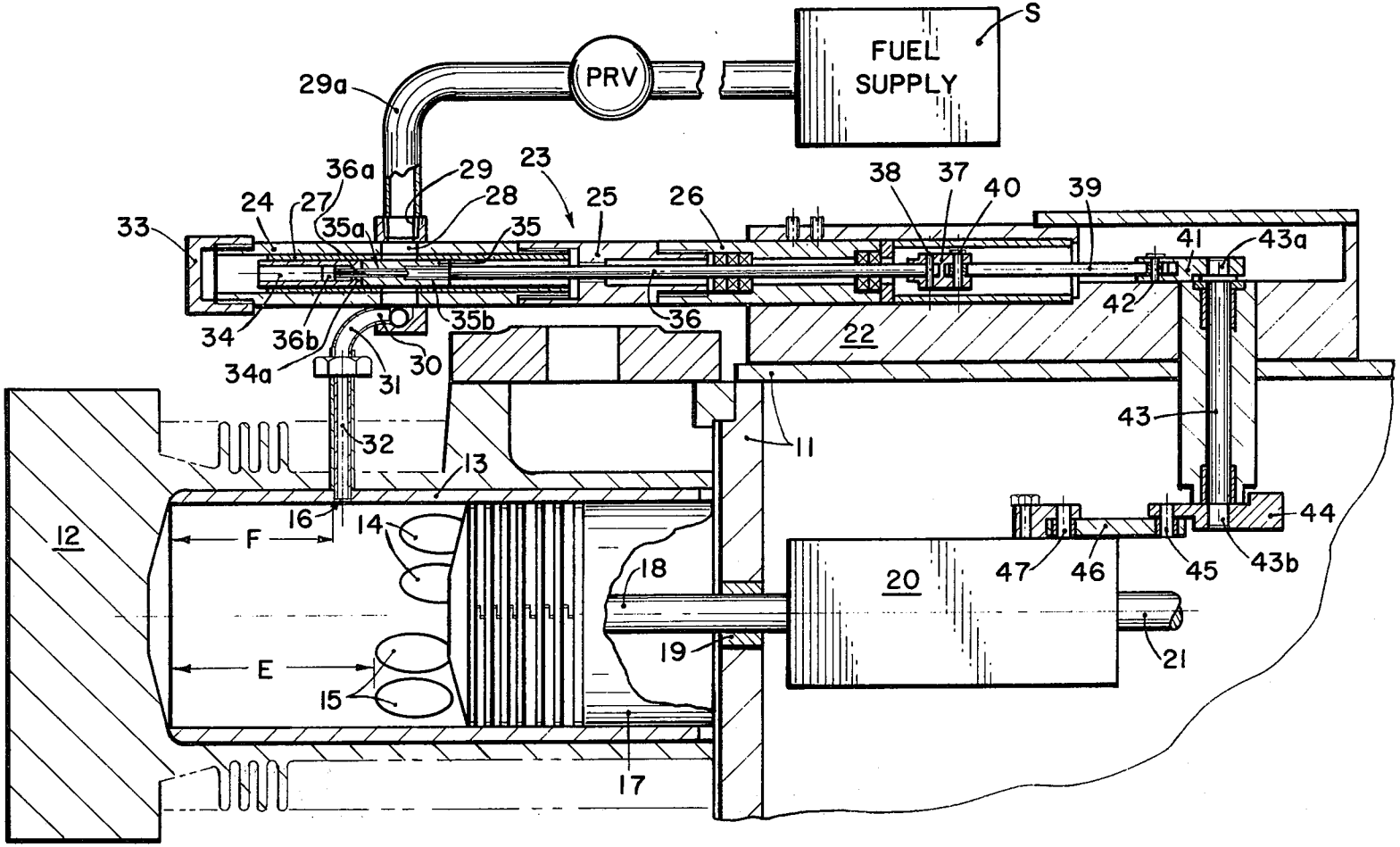
FIG. 1 is a fragmentary longitudinal and vertical sectional view of the invention.

The reference numeral 11 is designated the engine's housing with an air cooled cylinder 12 suitably mounted thereon. A liner 13 in the cylinder has a plurality of air intake ports 14, a plurality of exhaust ports 15 and at least one fuel inlet hole 16. In one embodiment of the invention the axial distance F from the inner end of the cylinder to the inner edge of fuel hole 16 is approximately 2.737 inches, the distance E from said end to the inner edges of exhaust ports 15 is approximately 4 inches. Hole distance F is determined by the formula:

$$F/E = (P_e/P_f)^{(1/1.4)}$$

where $P_e$ is exhaust pressure and $P_f$ is fuel pressure. In the above mentioned embodiment, $P_e$ is an exhaust pressure of 14.7 psi and $P_f$ is a fuel pressure of 25 psi.

A piston 17 in the cylinder has a piston rod 18 that extends through a seal 19 and into housing 11. The piston rod is operably connected to a synchronizing and counter-balancing mechanism 20 which, in turn, is operably connected to an energy absorbing device (not shown) by a connecting rod 21. The mechanism may be the same as that disclosed in U.S. Pat. No. 3,501,088.

Suitably mounted on the top of housing 11, is a housing 22 on which a control valve 23 is mounted. The body of the valve includes a plurality of joined tubular sections 24, 25 and 26 which have a common axis extending generally parallel to the axis of cylinder 12. Section 24 has a liner 27 therein and a transverse slot 28 through both that connects a fuel inlet coupling 29 to a fuel outlet coupling 30. Coupling 29 is adapted to be connected to a source of fuel under a constant pressure, such as propane gas in a container S while coupling 30 is connected through pipes 31–32 to hole 16. The outer end of section 24 is closed by a cap 33. A two part valve head includes a first sleeve-shaped plunger 34 with an inwardly extending annular flange **34*a* and a second sleeve-shaped plunger 35 with a stepped bore 35*a* and 35*b* therein. A valve stem 36 is connected at one end to a crosshead 37 by pin 38 and extends through suitable packings and bearings in section 25 and 26, is secured to plunger 36 as by threads and has a reduced diameter extension 36*a* which extends into plunger 34. A head 36*b* is spaced from the flange 34*a* so as to provide a gap between the adjacent ends of plungers 34 and 35 when stem 36 moves to the right, as viewed in the drawing, and carries with it head 36*b*. The head will engage flange 34*a* before the gap reaches slot hole 28 so as to carry the plunger 34** with it to cover the hole after fuel has passed through the gap to the cylinder.

The valve is actuated by a connecting rod 39, connected at one end to crosshead 37 by a pin 40 and at its other end to a crank arm 41 by a pin 42. The crank arm is connected to the non-round end extension **43*a* of a crankshaft 43 supported in suitable bearings. The other end of the crankshaft has a second non-round extension 43*b* to which a second crank arm 44 is connected. Crank arm 44 is connected by a pin 45 to a connecting rod 46 which, in turn, is connected to the mechanism 20 by a pin 47**.

OPERATION

The elements of the invention are illustrated in the positions they have at the end of a combustion or power stroke. As the piston moves to the left, counter-balancing mechanism 20 moves to the right and, through the crankshaft mechanism, initially carries valve stem 36 and plunger 35 only therewith. Friction between plunger 34 and liner 27 is greater than that between stem portion **36*a* and 34. Also, plunger 35*a* accelerates more rapidly than does plunger 34. After head 36*b* picks up valve plunger 34, the gap between the valve plunger starts to register with hole or holes 16 to supply fuel, such as gas to the cylinder. The fuel injection is timed so that the exhaust ports 15 are closed by the piston just about when the fuel particles first entering the cylinder through hole 16** reach these ports.

Therefore, the timing of fuel injection is selected in relation to the inner edges of the exhaust ports and the velocity of the fuel particles and the distance the particles travel before reaching the exhaust ports. The position of valve plunger 34 is adjusted to cause closing of slot 28 approximately when, but preferably before, hole 16 is closed by piston 17. Hole 16 is located by the previously mentioned formula to make sure that the hole is closed by the piston before the pressure in the combustion chamber exceeds the pressure of the fuel, which is preferably maintained at a constant value. After hole 16 is closed, the piston moves on to the end of the compression stroke. The motion produced by mechanism 20, through the crankshaft mechanism, on the valving elements is such that during the compression stroke, the right hand end of plunger 34 does not move to the right independent of plunger 35, due to deceleration of plunger 35, until the right hand end of plunger 34 has passed the right hand edge of slot 28. This prevents premature termination of fuel flow. Upon ignition of the fuel mixture by conventional means (not shown) the piston moves to the right and mechanism 20, valve stem 36 and plunger 35 only move to the left, to close the gap, if any, between plunger 34 and 35, and to thereafter move their junction past slot 28. The motion produced by mechanism 20, through the crankshaft mechanism, on the valving elements is such that during the power stroke, deceleration of plunger 35 does not cause plunger 34 to move to the left independent of and ahead of plunger 35 before their junction has passed the left hand edge of slot 28.

Figures 2, 3, 4, 5:
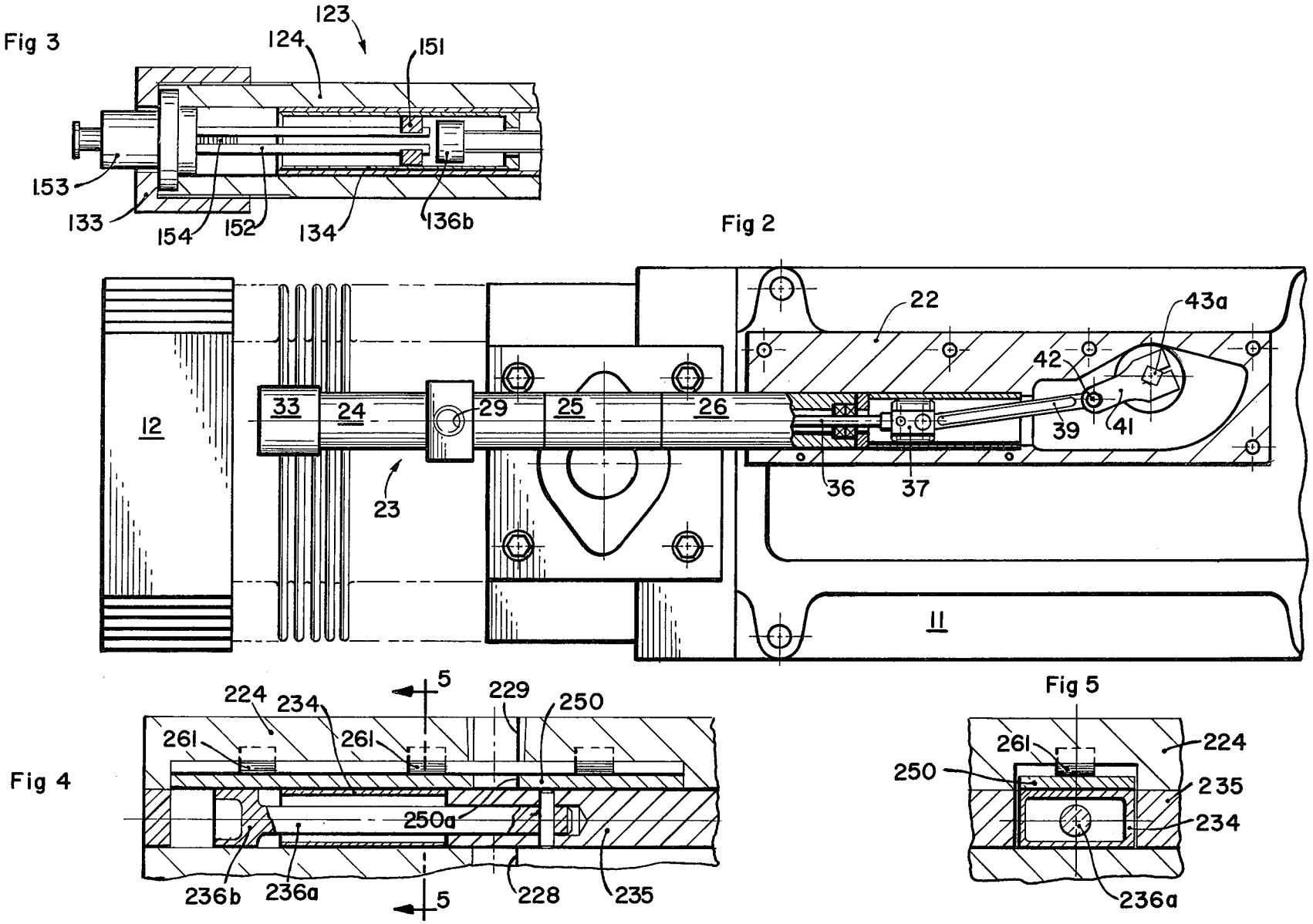
FIG. 2 is a fragmentary plan view of the portion of the invention disclosed in FIG. 1.
FIG. 3 is a modification of a portion of the control valve on an enlarged scale.
FIG. 4 is another modification of the control valve.
FIG. 5 is a sectional view taken along line 5—5 of FIG. 4.

FIG. 3 of the drawing discloses a valve 123 similar to valve 23 except that friction or breaking means, in the form of a pair of break shoes 151 embedded in the free ends of a pair of cantilever arms 152, extend into and bear against opposite sides of the inner surface of valve plunger 134. The fixed ends of arms 152 are supported by head 153, which is clamped against housing portion 124 by cap member 133. If needed an adjustment plug 154 may be positioned between the arms 152 near head 153 to spread the arms to increase the friction between break shoes 151 and plunger 134. In this arrangement, the lagged movement of plunger 134 with respect to the movement of head **136*b* is due more to the friction or breaking action of shoes 151 than to the acceleration or deceleration of the valve elements, which may be desirable during starting or transitional status of operation of the engine. The adjustment may also be achieved automatically by utilizing pressure or other means to move, for example, adjustment plus 154** to a higher friction position during the starting of the engine.

FIGS. 4 and 5 illustrate another embodiment of the control valve wherein the mechanically driven plunger 235 is rectangular in cross-section and plunger 234 is a rectangular tube of the same width and thickness as plunger 235. A head **236*b* on a stem 236*a* is spaced from the adjacent end of plunger 234 when the plunger is abutting plunger 235. The upper wall of the plungers chamber, as viewed in the drawing, is a plate 250 that is resiliently biased against the upper surface of plungers 234 and 235 by means of coil springs 261. A hole or slot 250*a* is in alignment with inlet 229 and outlet 228. With this arrangement, gas pressures in the valve have little or no effect on plunger 234 and the major accelerations in the system may be reduced. The operation of this embodiment of the control valve is generally the same as that of FIGS. 1 and 3**.

While linear fuel valving means are illustrated, it is to be understood that a rotary or an oscillatory valving means for actuation by the counterbalancing mechanism or by the piston and utilizing the same principles may be used to provide the same fuel delivery.

From the above description of the structure and operation of the invention, it is deemed apparent that the fuel control elements are arranged to provide the longest possible fuel injection interval for a given fuel injection pressure and to be at least affected by the hottest portion of the combustion chamber and the combustion gases therein. This provides for better fuel mixing for combustion, simpler injection elements, longer life for the fuel elements and safer operation than prior art engines.

I claim:

1. In a two-cycle free piston engine the combination comprising a valve body having an inlet adapted to be connected to a source of fuel and an outlet adapted to be connected to an engine cylinder, a first valve head member moveable in said body and arranged to permit or to prevent fuel flow through said body, a second valve head member moveable in said body and arranged to permit or to prevent fuel flow through said body, lost-motion connection means between said first and second valve head members and arranged to cause the combined action of said members to prevent fuel flow through said body when they both are moved by said means when said means moves in one direction and to re-arrange and to move said valve head members so as to permit fuel to flow through said body during a portion of the reverse movement of said means, and means for operably connecting said lost-motion connecting means to a portion of the engine that moves in synchronism with the engine's piston.

2. The combination of claim 1 wherein said valve body has a linear cavity therein and said valve head members slide coaxially therein.

3. The combination of claim 2 wherein said valve head members are abutting each other when they are moved in one direction and are separated when they move in the reverse direction.

4. The combination of claim 3 wherein said inlet and outlet are substantially diametrically opposed.

5. The combination of claim 1 wherein the arrangement is such that the valve head members are caused to be separated at the valve open position due to acceleration of said engine portion moving in one direction and to be abutting each other at the same position due to acceleration of said engine portion when moving in the opposite direction.

6. The combination of claim 1 wherein the arrangement is such that the valve head members are caused to be separated at the valve open position primarily due to friction between one of said valve head members and said body when said engine portion is moving in one direction and to be abutting each other at the same position due to the same friction when said engine portion is moving in the opposite direction.

7. The combination of claim 6 wherein the friction is substantially less during normal operation of the engine than during the starting period of the engine.

8. A free piston engine comprising a cylinder having a combustion chamber, a piston in said chamber, said cylinder having an air intake port in the side thereof and an exhaust outlet port in the side thereof with said outlet port being located with respect to said intake port so as to enable said piston to seal off said air intake port before it seals off said exhaust port during a compression stroke, a fuel inlet hole in the side of said cylinder and located axially inwardly of said exhaust port a distance just sufficient to enable said piston to cut off fuel flow through said hole just prior to the pressure in the cylinder exceeding the fuel supply pressure, and valve means operated in time relationship with said piston for initiating fuel flow to said cylinder for a period lasting only for a portion of the compression stroke of the piston and starting at a piston position that enables the first fuel particles entering the cylinder to approximately reach said exhaust port just before said exhaust port is closed by said piston, said valve means having a fuel inlet port and a fuel outlet port and a valve head having two relatively moveable parts controlling said ports, a first of said valve head parts being operably connected to said piston and a second of said valve head parts having a lost motion connection with said first part so that during a power stroke of said piston said parts are together when their junction passes said fuel inlet and outlet ports and during a portion of a compression stroke of said piston parts are separated to form a fuel flow gap therebetween when the gap passes said fuel inlet and outlet ports.

9. The invention of claim 8 wherein said valve parts are coaxial and slideable between said fuel inlet and said fuel outlet.

* * * * *